US008764169B2

(12) United States Patent
Harada et al.

(10) Patent No.: US 8,764,169 B2
(45) Date of Patent: Jul. 1, 2014

(54) INKJET RECORDING DEVICE AND PRINTING HEAD

(75) Inventors: Nobuhiro Harada, Hitachi (JP); Akira Miyao, Hitachi (JP); Koji Horikawa, Hitachi (JP); Hisashi Umetsu, Hitachi (JP); Takuya Moriai, Hitachi (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 206 days.

(21) Appl. No.: 13/389,609

(22) PCT Filed: Aug. 11, 2009

(86) PCT No.: PCT/JP2009/064170

§ 371 (c)(1),
(2), (4) Date: Apr. 16, 2012

(87) PCT Pub. No.: WO2011/018841

PCT Pub. Date: Feb. 17, 2011

(65) Prior Publication Data

US 2012/0194586 A1 Aug. 2, 2012

(51) Int. Cl.

| | |
|---|---|
| ***B41J 2/09*** | (2006.01) |
| ***B41J 2/085*** | (2006.01) |
| *B41J 2/095* | (2006.01) |

(52) U.S. Cl.

CPC .. *B41J 2/085* (2013.01); *B41J 2/09* (2013.01); *B41J 2/095* (2013.01)

USPC ..... 347/77

(58) Field of Classification Search

CPC ..... B41J 2/04526; B41J 2/02; B41J 2/085; B41J 2/09; B41J 2/095

USPC ..... 347/9–11, 40, 74, 77

See application file for complete search history.

(56) References Cited

U.S. PATENT DOCUMENTS

| | | | | |
|---|---|---|---|---|
| 3,739,395 | A | 6/1973 | King | |
| 4,219,822 | A | 8/1980 | Paranjpe | |
| 4,533,925 | A * | 8/1985 | Tsao et al. | 347/74 |
| 5,457,484 | A | 10/1995 | Regnault et al. | |
| 7,992,974 | B2 * | 8/2011 | Matsuda et al. | 347/77 |

FOREIGN PATENT DOCUMENTS

| | | |
|---|---|---|
| JP | 57-167271 | 10/1982 |
| JP | 8-142332 | 6/1996 |
| JP | 2945286 | 6/1999 |
| JP | 2006-111024 | 4/2006 |

OTHER PUBLICATIONS

European Patent Office Communication for Corresponding European Patent Application No. 09848260.7, mailed Apr. 13, 2013.

Office Action issued in Chinese Patent Application No. 200980160867.0 on Oct. 30, 2013.

* cited by examiner

*Primary Examiner* — An Do

(74) *Attorney, Agent, or Firm* — Antonelli, Terry, Stout & Krauss, LLP.

(57) ABSTRACT

In an inkjet recording device, nozzles are arranged orthogonally to a deflection direction of deflection electrodes. Ink jetted from each nozzle is charged by a pair of charging electrodes. Charged droplets are deflected by an electric field formed thereby. Voltages applied to each electrode and timings thereof can be independently adjusted.

7 Claims, 13 Drawing Sheets

Fig. 10

| | Nozzle A | Nozzle B | |
|---|---|---|---|
| Print start position | [ 1500] | [ 3800] | Dot / Scan |
| Character height | [ 100] | [ 090] | |
| Droplet usage rate | [ 001] | [ 001] | 1/n |
| Print column interval adjustment | [ 001] | [ 001] | Dot |

INKJET RECORDING DEVICE AND PRINTING HEAD

TECHNICAL FIELD

The present invention relates to an inkjet recording device (inkjet printer) and a printing head used therefor, and, for instance, to an industrial inkjet recording device used for marking products and a printing head used therefor.

BACKGROUND OF THE INVENTION

First, referring to FIG. 1, a control technique for changing a transfer speed of a print object for a conventional inkjet recording device will be described. In an inkjet recording device, for printing the print object (also referred to as "workpiece"), ink droplets jetted from one nozzle are used. In the case where the transfer speed of the print object is relatively slow, one of every plurality of ink droplets jetted from the one nozzle is treated as a charging target and thus a charging voltage is applied thereto. The upper part of FIG. 1 illustrates an example where one of every two generated ink droplets is treated as a charging target. This case is defined as a droplet usage rate of 1/2. In order to reduce the character width of a printed result at the same transfer speed, increase in droplet usage rate as with the middle part of FIG. 1 can respond the requirements. In this example, the droplet usage rate is changed to 1/1.

As shown in the lower part of FIG. 1, increase in scan interval can also control the print character width. In this case, the generation period of the ink droplet jetted from the nozzle is set constant so as to form an optimal ink droplet shape according to an ink pressure, an ink viscosity and the like; the ink droplet is charged and then deflected and flies to a prescribed position. In the case of a fixed charging voltage, the character width of the printed result tends to get wider as the transfer speed of the print object increases.

FIG. 1 shows an example of performing one line printing. On the other hand, for instance, as shown in Patent Literature 1 (U.S. Pat. No. 5,457,484), an inkjet recording device has been invented that at least two nozzles are arranged at a printing head in the case of multi-line printing, which is for at least two lines, and printing is performed according to each nozzle and each line. This scheme has a configuration including a plurality of systems of charging voltages and deflecting voltages, the number of the plurality conforms to the number of nozzles. This scheme is effective for reducing the character width of the printed result at high speed printing in the case of multi-line printing.

SUMMARY OF THE INVENTION

However, in the case of performing one line printing using the technique disclosed in Patent Literature 1 (U.S. Pat. No. 5,457,484), the character width of the printed result in high speed printing cannot be reduced. It can be considered that, if the character width of the printed result is widened, the character lies off a print area for the print object to cause failed printing. Accordingly, even if the transfer speed of the print object becomes high, it is required to realize print control that prevents the character width from widening.

Incidentally, as a technique that prevents the character width of the printed result from widening even if the transfer speed of the print object becomes high, a section which increases a droplet usage rate used for printing of ink jetted from the above-described nozzle and a section which reduces a generation period of the ink jetted from the nozzle are effective.

However, the former has a limit of the droplet usage rate of 1/1, which in turn limits a range where speedup is supported. The latter is specifications that preliminarily set a constant period so as to form an optimal ink droplet shape on the basis of an ink pressure, an ink viscosity and the like. The specifications have a factor that causes a printing failure due to a failure in formation of an ink droplet in the case of only changing an ink generation period.

Measures to realize speedup of at least a droplet usage rate of 1/1 includes printing through use of a plurality of nozzles. Note that the technique disclosed in Patent Literature 1 (U.S. Pat. No. 5,457,484) realizes printing of at least two lines at a printing speed for one line. According to the above description, this technique cannot prevent the character width of the printed result from widening in the case where the transfer speed of the print object becomes high.

There is a scheme that stores a plurality of nozzles in a printing head, binarizes a charging voltage, charges ink droplets and thereby separates presence or absence of deflection between deflection electrodes, thus separating ink droplets to be recovered by a gutter and ink droplets to be used for printing from each other. However, this scheme has a problem that increases the number of nozzles and thereby degrades reliability and increases the cost.

The present invention is made in view of these situations, and provides a technique for improving print quality by preventing the character width of the printed result from widening even in the case where the transfer speed of the print object becomes high in an inkjet recording device.

In order to solve the above problems, the present invention defines a direction in which a plurality of nozzles are arranged to be orthogonal to a deflection direction of ink droplets in an inkjet recording device. Ink jetted from the plurality of nozzles is charged by pairs of charging electrodes, the number of pairs being identical to the number of nozzles. In one deflection electric field formed by a positive and negative pair of deflection electrodes, each charged droplet is deflected. The configuration includes a function capable of independently adjusting the value of a charging voltage to be applied to each pair of charging electrode and application timing of the charging voltage.

That is, an inkjet recording device according to the present invention is an inkjet recording device that performs printing on a print object being transferred. This device includes a plurality of nozzles; a plurality pairs of charging electrodes; a pair of deflection electrodes; an input section; and a controller. The charging electrodes are disposed so as to correspond to the respective nozzles, and charge ink droplets jetted from these nozzles. The deflection electrodes are sections which deflect the charged ink droplets. The direction in which the nozzles are arranged is orthogonal to the deflection direction of the charged ink droplets. The controller develops the print character input from the input section in a manner of a dot matrix, assigns pieces of dot data to the respective nozzles, and controls an operation of jetting ink from the nozzles, a value of a charging voltage to be applied to the pair of charging electrodes, and an application timing. This configuration enables one line of a character string to be printed on the print object by the plurality of nozzles. The deflection electrodes include a pair of plate electrodes irrespective of the installed number of the nozzles and the installed number of the pairs of the charging electrodes. The controller prints the one line of the character string on the print object by sequentially performing printing of a dot string from the nozzles.

The input section includes a print condition setting section capable of independently setting print conditions for the respective nozzles. In this case, the controller controls the operation of jetting ink, the value of the charging voltage, and the application timing, according to the print conditions set from the print condition input section.

More specifically, when an instruction of adjusting a print character height is issued from the print condition setting section, the controller adjusts the value of the charging voltage to be applied to the charging electrodes corresponding to the nozzle for which the print character height is to be adjusted. When an instruction of adjusting a print start timing is issued from the print condition setting section, the controller adjusts an application timing of the charging voltage to be applied to the charging electrodes corresponding to the nozzle for which the print start timing is to be adjusted. When an instruction of adjusting a print column interval is issued from the print condition setting section, the controller adjusts the print column interval by applying, to the charging electrode, a charging voltage for inserting a non-print dot at which printing is not performed on the print column interval, at a unit of an ink droplet generating dot according to an amount of adjustment of the print column interval for each nozzle. When droplet usage rates of the ink droplets to be jetted from the respective nozzles are set to be different from each other from the print condition setting section, the controller realizes a special print pattern by controlling a slant of a dot string to be generated at each nozzle on the basis of the usage rate.

Further characteristics of the present invention will become apparent from the best mode of implementing the present invention and accompanying drawings.

These and other objects, features and advantages of the invention will be apparent from the following more particular description of preferred embodiments of the invention, as illustrated in the accompanying drawings.

BRIEF DESCRIPTION OF THE DRAWINGS

FIG. 10 is a diagram showing a setting example on a setting screen (GUI) according to the present embodiment.

DESCRIPTION OF THE PREFERRED EMBODIMENT

Figure 1:
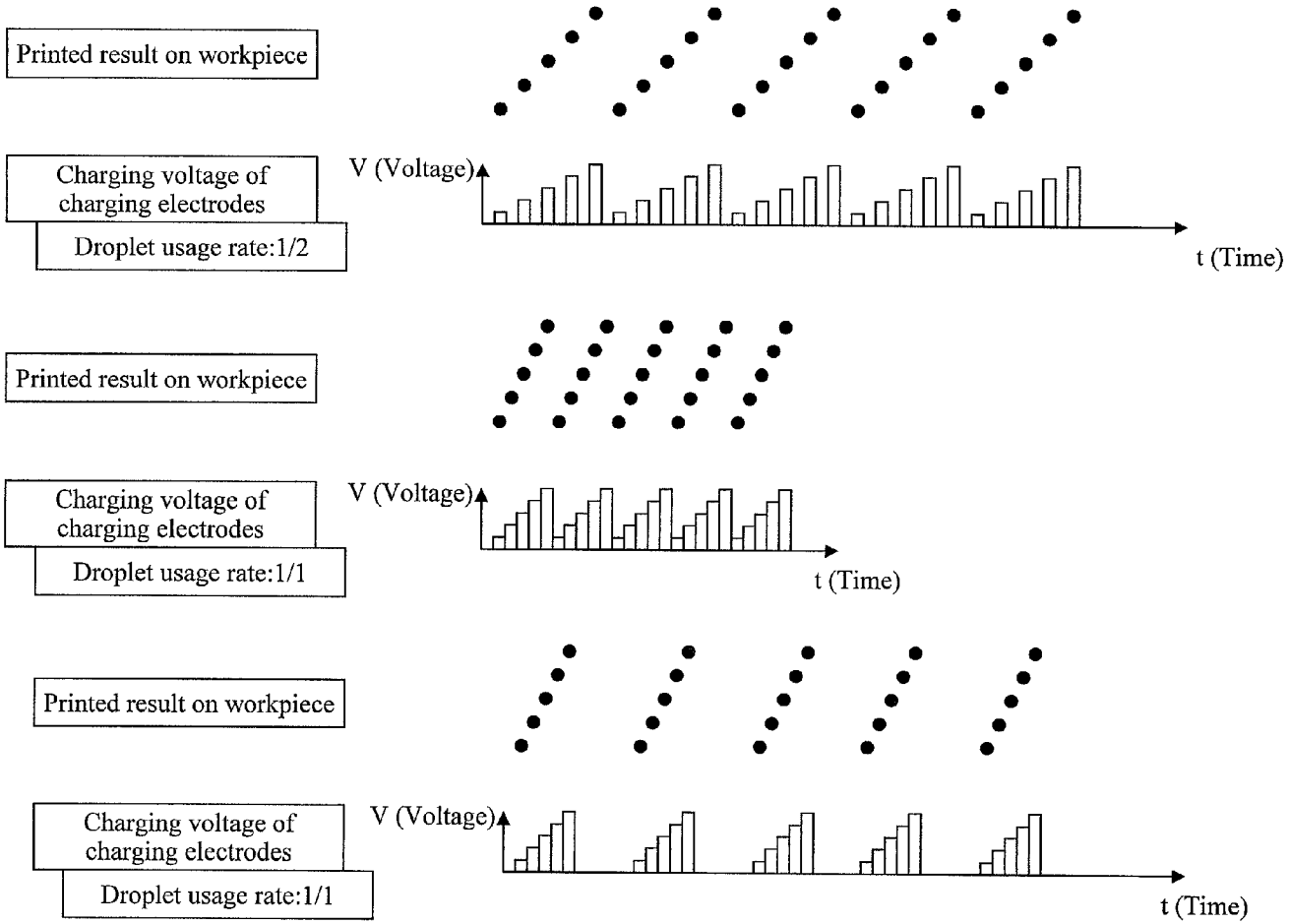
FIG. 1 is a diagram showing print examples (medium speed printing) and examples of charging voltage waveforms (1) according to a conventional nozzle.

The present invention performs one line printing using a plurality of nozzles, which prevents the character width of a printed result from widening even in the case where the transfer speed of the print object becomes high.

However, in order to realize this technique, it can be considered that there mainly are following two problems. That is, a first problem is in that dot pitches in the vertical direction are not aligned according to printing from the plurality of nozzles; in other words, difference in print character height due to ink jetted from the nozzles degrades print quality. The print character height is determined by a speed of an ink droplet jetted from the nozzles, an amount of charge charged by charging electrodes, a strength of a deflection electric field formed in deflection electrodes and the like. However, this height varies according to unevenness between elements. Accordingly, in order to address this problem, it is required to provide a mechanism that adjusts print character heights separately for the respective nozzles. In the present invention, it can be considered that a section which independently adjusts charging voltage values for the respective nozzles is most effective.

As a second problem, it can be considered that uneven dot pitches in the horizontal direction according to printing from the plurality of nozzles in a manner of out of alignment degrades print quality. In order to address this problem, it can be considered to be most effective to adopt a configuration of aligning the nozzles in the horizontal direction (so as to be orthogonal to the deflection direction) and to independently control print start timings at the respective nozzles.

The embodiment of the present invention will hereinafter be described with reference to attached diagrams. It should be noted that the present embodiment is an example for realizing the present invention but does not limit the technical scope of the present invention. Configurational components common to the drawings are assigned with identical reference numerals.

<Circuit Configuration of Inkjet Recording Device>

Figure 4:
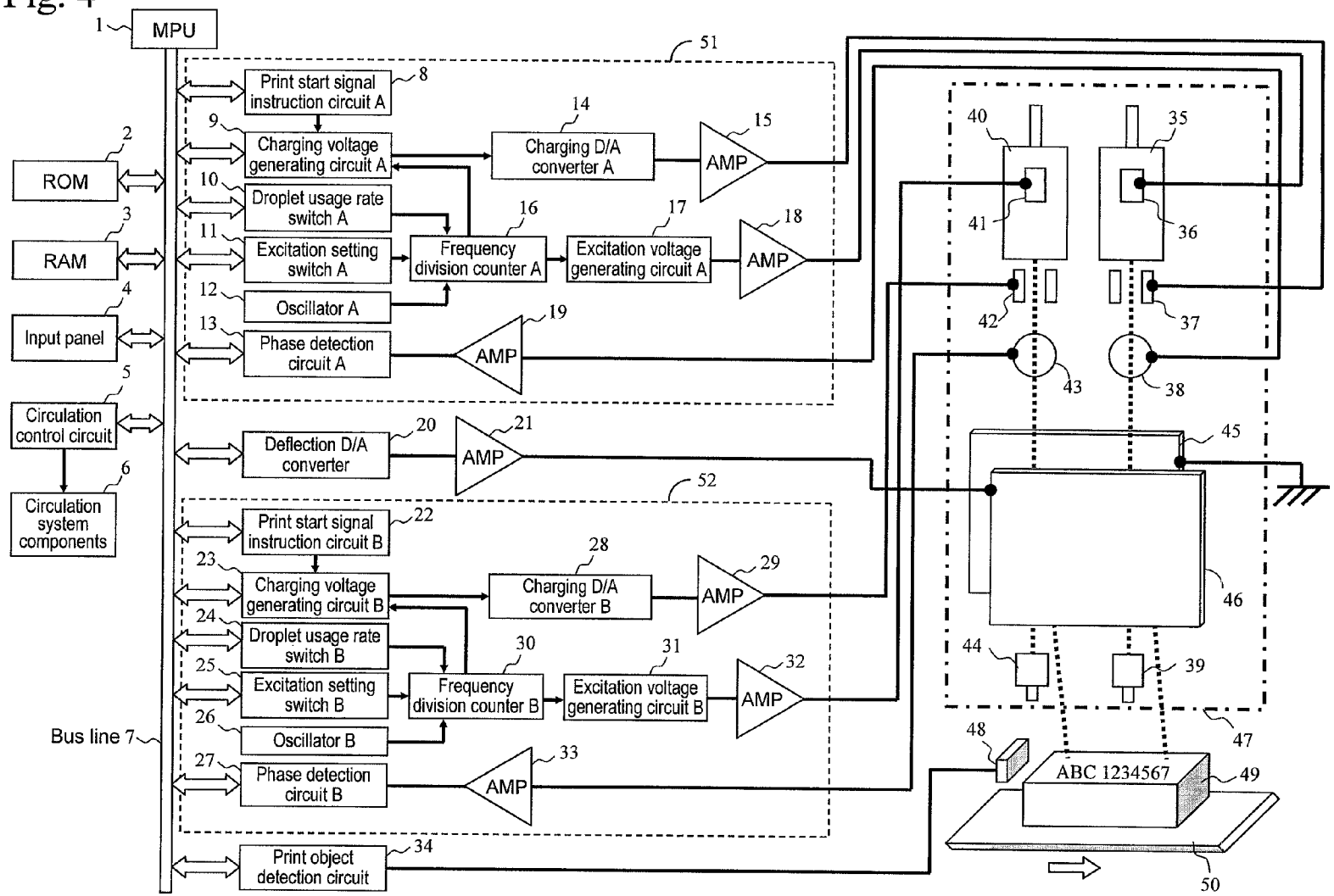
FIG. 4 is a block diagram showing an overall circuit configuration of an inkjet recording device according to an embodiment of the present invention.

FIG. 4 is a block diagram showing an overall circuit configuration of an inkjet recording device according to the embodiment of the present invention. FIG. 4 shows a circuit configuration of the inkjet recording device including two nozzles. However, the number of nozzles may be three or more.

As shown in FIG. 4, the inkjet recording device includes: an MPU (micro processing unit) 1 controlling the entire inkjet recording device; a ROM (read-only memory) 2 preliminarily storing a program and the like; a RAM (random-access memory) 3 temporarily storing data in the inkjet recording device; an input panel 4 that also serves as a display unit and receives an input of content to be printed; a circulation control circuit 5 controlling circulation system components 6, which include a pump for pressurizing ink, and pressure reducing valve and an electromagnetic valve that are for adjusting the pressure; a deflection D/A converter 20 digital/analog-converting data instructed by the MPU 1; an AMP 21 amplifying the signal after the D/A conversion; a charging system circuit A_51; a charging system circuit B_52; a printing head 47; a workpiece sensor 48 detecting a print object (workpiece) 49; and a print object detection circuit 34 determining whether the print start timing is a desired timing or not on the basis of a detection result from the workpiece sensor 48. The blocks other than the printing head 47 and the workpiece sensor 48 are connected to the MPU 1 via a bus line 7, and controlled by the MPU 1.

The charging system circuit A_51 includes: a print start signal instruction circuit A_8 outputting a print start signal according to an instruction from the MPU 1; a charging voltage generating circuit A_9 generating a charging voltage in response to the timing of print start signal; a charging D/A converter A_14 digital/analog-converting the charging voltage value; an AMP 15 amplifying the D/A-converted charging voltage value; a droplet usage rate switch A_10 for setting a droplet usage rate; an excitation setting switch A_11 for setting an ink droplet generation period; an oscillator A_12; a phase detection circuit A_13 detecting a phase of an ink droplet jetted from the nozzle; a frequency division counter A_16 dividing an oscillation clock on the basis of information on the usage rate and the ink droplet generation period; an excitation voltage generating circuit 17 generating an excitation voltage; and an AMP 18 amplifying an excitation voltage value. The charging system circuit B_52 has a configuration identical to that of the charging system circuit A_51. The description thereof is omitted.

The printing head 47 includes two printing head configuration units. The printing head configuration unit A includes a nozzle A_35 for jetting ink; an electrostrictive element A_36 that is operated by an excitation voltage and forms a droplet from the ink; charging electrodes A_37 for charging the ink droplet; a phase retrieval sensor A_38 searching for an ink droplet generation timing; deflection electrodes 45 and 46 for deflecting the ink droplet; and a gutter A_39 for recovering ink droplets having not used for printing. The other printing head configuration unit B has a configuration identical to that of the printing head configuration unit A.

Subsequently, an overview of a control operation for printing using ink jetted from the nozzle A_35 will be described. First, the charging voltage generating circuit A_9 creates various types of data, such as voltage data for charging ink droplets and timing data, on the basis of print content data input from the input panel 4, stores the created data, and transfers the data to the charging D/A converter A_14 in synchronization with the print start timing according to an instruction from the print start signal instruction circuit A_8. The voltage value converted into an analog value by the charging D/A converter A_14 is amplified by the AMP 15, and applied to the charging electrodes A_37 in synchronization with the print start timing.

An operator sets usage rate of charged droplets used for printing, using the droplet usage rate switch A_10. The higher the usage rate is set, the higher the speed of printing is realized. However, in the case of a low usage rate where print quality deteriorates owing to an adverse effect of print distortion, the situations become inverted. Further, the operator determines a generation period of ink droplets to be jetted from the nozzle using the excitation setting switch A_11.

The oscillation clock output from the oscillator A_12 is divided by the frequency division counter A_16 on the basis of information from the droplet usage rate switch A10 and the excitation setting switch A11, thereby creating a timing signal, which is input into the charging voltage generating circuit A_9 and the excitation voltage generating circuit A_17. A signal output from the excitation voltage generating circuit A_17 is amplified by the AMP 18, and applied to the electrostrictive element A_41. The electrostrictive element A_36 converts the electric signal from the AMP 18 into an oscillation, and applies the oscillation to the ink for pressurization, thereby jetting an ink droplet.

The phase retrieval sensor A_38 searches for the timing of generating the ink droplet to be jetted. Optimal printing requires application of the charging voltage in synchronization with the ink droplet generation timing. Accordingly, the timing detected here is fed back and phase deviation (deviation in timings of jetting ink droplets and applying a charging voltage) is adjusted. More specifically, the signal detected by the phase retrieval sensor A_38 is amplified by the AMP 19, converted into a digital signal by the phase detection circuit A_13, and subsequently the ink droplet generation timing is checked by the MPU 1. Charging timing (phase) information at which the MPU 1 becomes optimal is output to the charging voltage generating circuit A_9.

The ink droplet charged by the charging electrode A_37 is deflected by flying through an electric field, which is formed by the positive deflection electrode 46 applied with a direct-current voltage and the negative deflection electrode 45 being grounded. The charged ink droplet to be used for printing flies away from the gutter A44, is jetted from the printing head 47, and adheres to a workpiece 49 as a print object, thus being provided for printing. Here, deflection is made according to the amount of charging of the ink droplet. That is, the amount of deflection of the ink droplet having a large amount of charging is large, and the amount of deflection of the droplet having a small amount of charging is small. The magnitude of direct-current voltage applied to the positive deflection electrode 46 is changeable by means of a configuration that causes the deflection D/A converter 20 to apply digital/analog conversion to data instructed by the MPU 1 according to character height information set from the input panel 4 and causes the AMP 21 to amplify the converted data.

The ink unused for printing, which is uncharged ink droplets and ink droplets charged for phase searching, is recovered by the gutter A44, and supplied again to the nozzle A_35 by circulation system components 6 including the pump.

The print object 49 is conveyed on a conveyor 50 and advances in a direction substantially perpendicular to the ink jetting direction and the ink deflection direction, thereby forming a print character (only the ink jetting direction is orthogonal to the conveying direction in the case of slantingly arranging the printing head 47 (see FIG. 5)). The print start timing is controlled by the MPU 1 through the print object detection circuit 34, which determines whether the print start timing is synchronous or not according to detection of the position of the workpiece by the workpiece sensor 48.

Configurational components in the printing head configuration unit B including the nozzle B_40 are identical to the configurational components for printing using ink jetted from the nozzle A_35, except for the positive deflection electrode and the negative deflection electrode. A control circuit for printing by ink jetted from the nozzle A35 is defined as a charging system circuit A_51. On the other hand, a control circuit for printing by ink jetted from the nozzle B_40 is defined as a charging system circuit B_52. Configurational elements of the charging system circuit B_52 include elements and components equivalent to those of the charging system circuit A_51.

The present embodiment adopts the configuration in which the plurality of nozzles are arranged in the printing head 47. However, the direction in which the nozzles are arranged is substantially orthogonal to the deflection direction defined by the deflection electrodes. The ink droplets generated from the respective nozzles and charged are deflected by the single pair of deflection electrodes irrespective of the number of nozzles and the number of pairs of charging electrodes. The direction of the electric field between the charging electrodes and the electric field between the deflection electrodes are substantially orthogonal to each other.

<Relationship of Arrangement of Printing Head and Workpiece and Configuration of Arrangement of Components in Printing Head>

Figure 5:
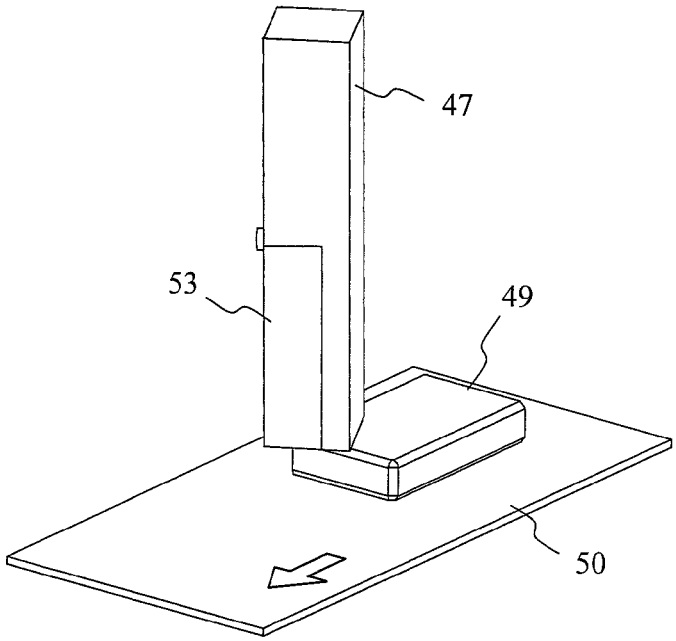
FIG. 5 is a diagram showing a schematic configuration of a printing head.
Figure 5:
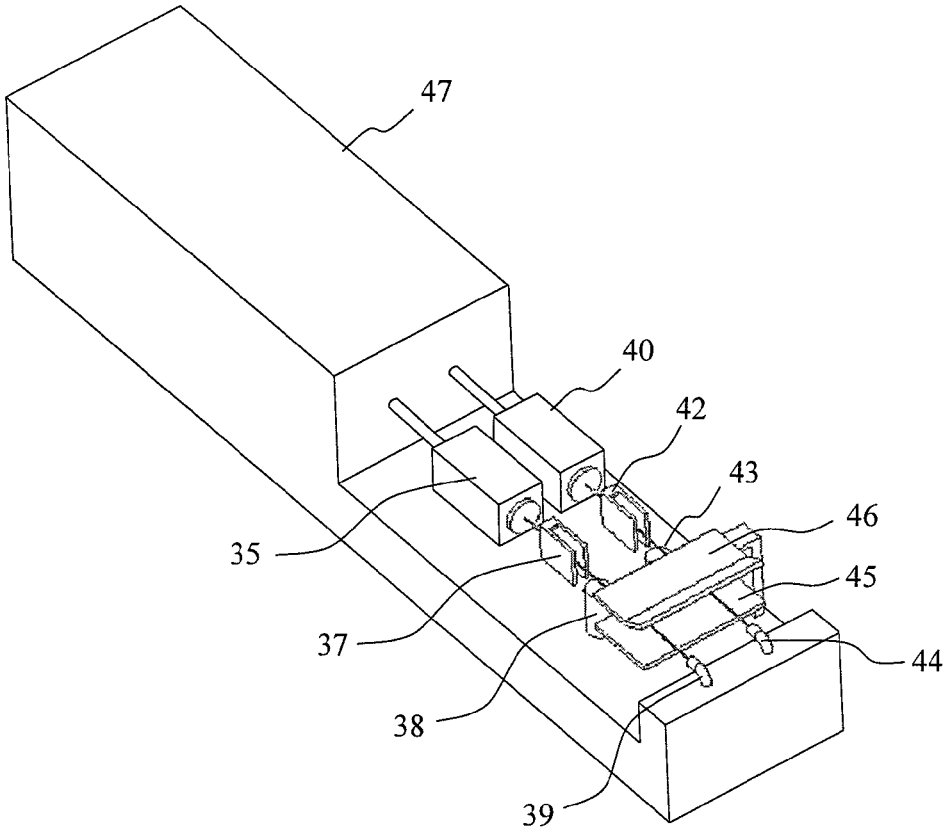

FIG. 5 is a diagram showing a relationship of arrangement between the printing head 47 and the workpiece and a configuration of arrangement of components in the printing head 47. In the case of printing the workpiece using the inkjet recording device, the printing head cover 53 is attached for actual usage. An internal configuration of the printing head includes components shown in FIG. 5, in the case of detaching the printing head cover 53.

As shown in FIG. 5, it is preferable that the printing head 47 be slantingly arranged with respect to the conveying direction of the workpiece (print object) 49. This can prevent a printed character from being slanted (e.g. see FIG. 2).

<Overview of Print Operation of Two-Nozzle Configuration>

(1) Next, a print operation according to the present invention will be specifically described. For the sake of further clarity, first, an operational principle in the case of printing using publicly known technique with one nozzle is described with reference to FIGS. 1 to 3.

FIG. 1 is a diagram showing an example of printed results and charging voltage waveforms, when a workpiece is transferred at a certain speed, in the case of one nozzle as described above. The upper part of FIG. 1 shows a case of a droplet usage rate of 1/2. The droplet usage rate of 1/2 means that one ink droplet as a charging target is selected from two ink droplets jetted from the nozzle according to this voltage waveform. A droplet usage rate of 1/1 means that every ink droplet jetted from the nozzle is selected as a charging target. A droplet usage rate of 1/3 means that one ink droplet as a charging target is selected from three ink droplets jetted from the nozzle. In the inkjet recording device according to this scheme, according to a principle that causes a charged ink droplet to fly to thereby perform printing, Coulomb repulsion between charged ink droplets decreases with increase in droplet usage rate. This enables the ink to accurately collide with the workpiece, thereby allowing favorable print quality. It should be noted that this diagram is not represented with consideration to that extent.

The middle and lower parts of FIG. 1 show examples of printed results, when the charging voltage waveform is changed, in the case where the transfer speed of the workpiece is identical to that of the upper part of FIG. 1. The middle part of FIG. 1 is a printed result with a droplet usage rate of 1/1, and a column interval in the lateral direction, or the conveying direction of the workpiece, is halved and the slanting degree of a printed character is oriented in the vertical direction in principle, in comparison with the upper part of FIG. 1. In the lower part of FIG. 1, the droplet usage rate is 1/1; this part shows a printed result in the case of inserting an uncharged droplet between columns. The column interval can be controlled by changing the number of uncharged droplets.

Figure 2:
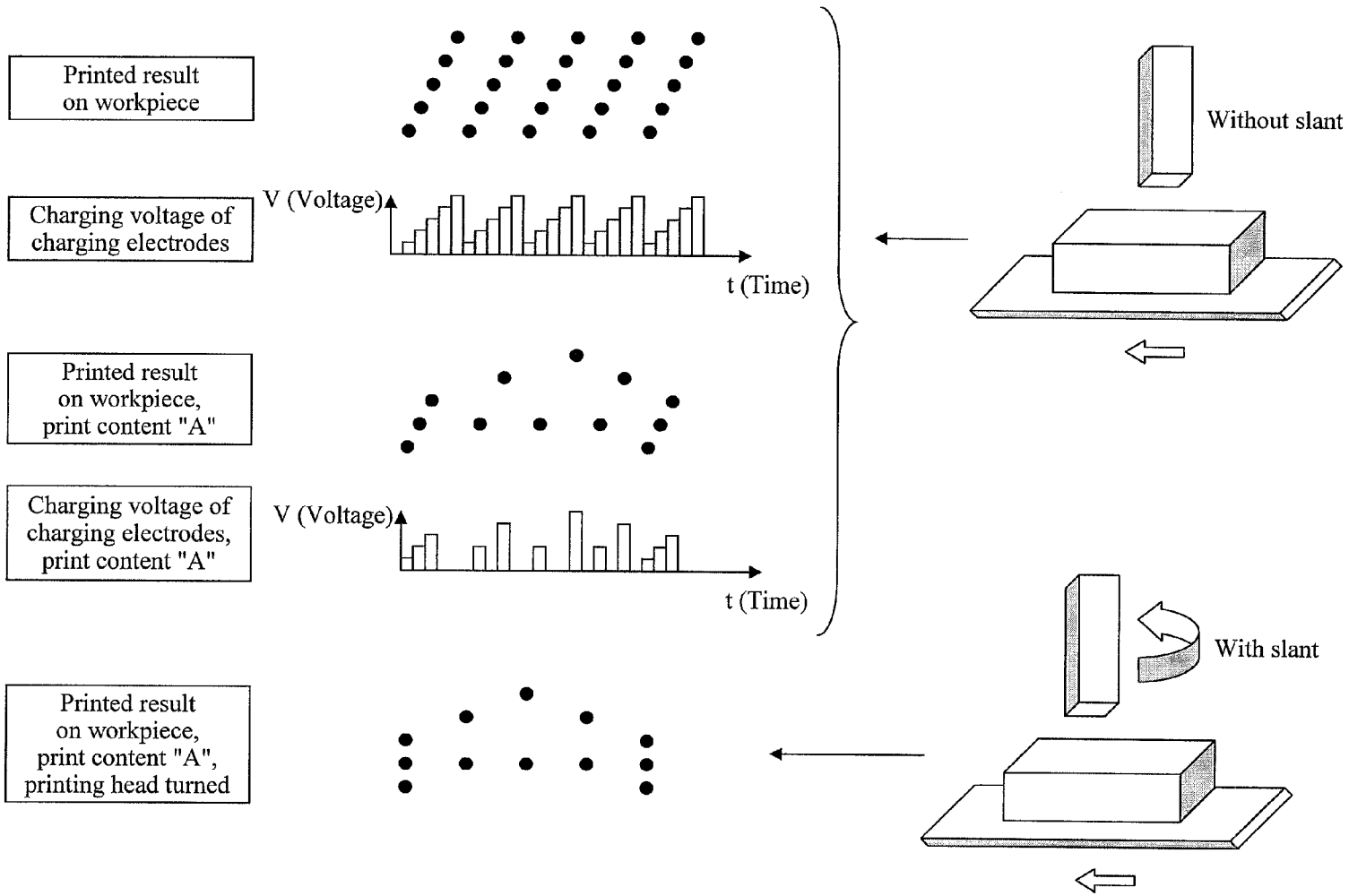
FIG. 2 is a diagram showing print examples (medium speed printing) and examples of charging voltage waveforms (2) according to the conventional nozzle.

FIG. 2 a diagram for illustrating a principle of a case of printing an actual print character (here, "A" is exemplified). The upper part of FIG. 2 shows a printed result in a case with a speed and a charging voltage waveform identical to those of the upper part of FIG. 1. The positional relationship between the printing head 47 and the workpiece 49 at this time is set to a state with no slant. The middle part of FIG. 2 shows a charging voltage waveform and a printed result on the workpiece in the case of performing control for printing "A" at a droplet usage rate of 1/1 with this positional relationship.

In the case where the positional relationship between the printing head and the workpiece is in the state with no slant, if the printed result on the workpiece is slanted as shown in the middle part of FIG. 2, slanting of the printing head enables favorable print quality with no slant to be acquired as shown in the lower part of FIG. 2.

Figure 3:
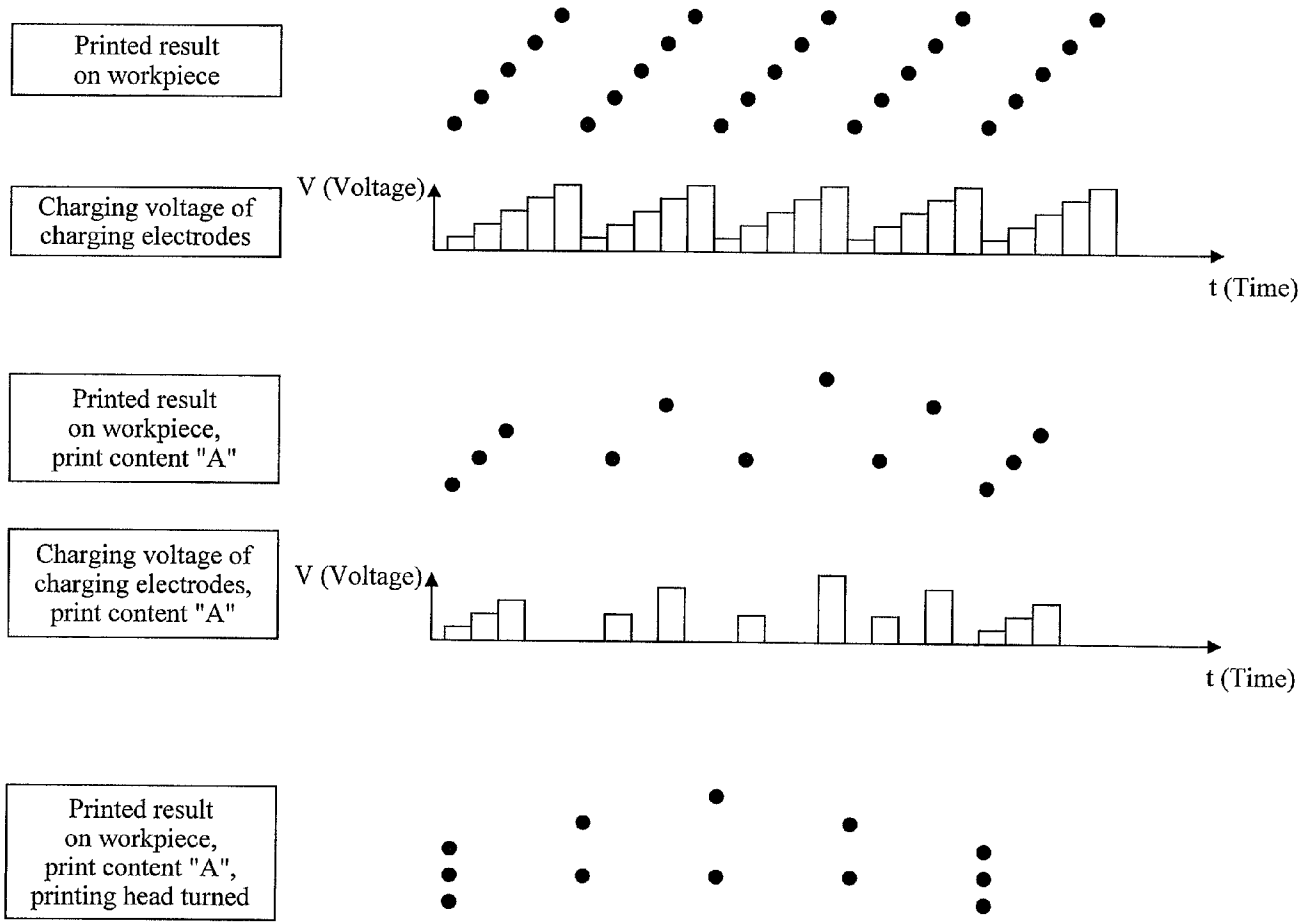
FIG. 3 is a diagram showing print examples and examples of charging voltage waveforms according to the conventional nozzle when a workpiece speed is increased.

FIG. 3 is a diagram showing an example of a printed result in the case of increasing the transfer speed of the workpiece with the charging voltage waveform identical to that in FIG. 2. The timing and period at which a charged ink droplet collides with the workpiece are identical. In contrast, the transfer speed is increased. Accordingly, there is a problem in that, as to the printed result, the column interval is increased in the workpiece conveying direction as with the lower part of FIG. 3, the print quality deteriorates owing to widening, and printing cannot be performed on a narrow workpiece owing to the widening of the print character width.

According to the above operational principle, in order to reduce the print character width even in the case of increasing the transfer speed of the workpiece, a section which increases the droplet usage rate is the most effective scheme. However, in the case of printing one line using one nozzle, the droplet usage rate of 1/1 defines the maximum print speed. Accordingly, in order to support further increase in transfer speed, it is required to printing one line using at least two nozzles.

(2) Next, on the basis of the above description, an operation in the case of printing one line of a character string using at least two nozzles will be described with reference to FIGS. 6 to 9.

Figure 6:
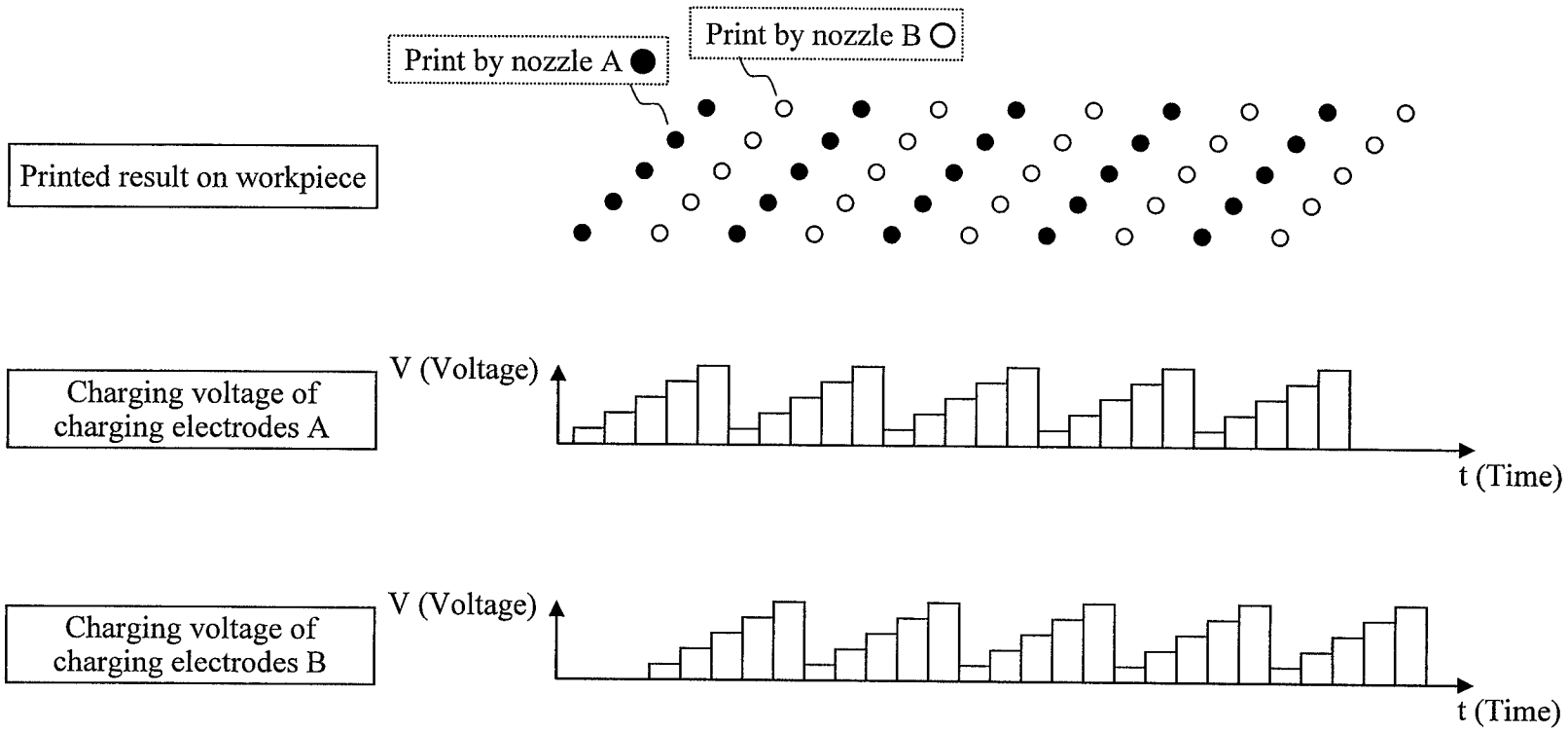
FIG. 6 is a diagram showing a print example (high speed printing) and an example of charging voltage waveforms (1) according to two-nozzle printing head configuration in the present embodiment.

FIG. 6 is a diagram showing an example of a printed result and an example of a waveform of a charging voltage applied to ink droplets jetted from the two nozzles in the case of printing with two nozzles. Printing is performed such that the print column interval from the nozzle A is interleaved with a print character column from the nozzle B (printing from nozzle A and printing from the nozzle B are alternately performed). This enables the print column interval to be reduced, that is, this enables the print character width to be reduced, thereby allowing high speed printing to be supported.

Here, according to the operational principle of this inkjet recording device, the print column interval by printing from the nozzle A and the print column interval by printing from the nozzle B can be evened so as to perform printing at an even separation to a certain extent. However, according to problems, such as unevenness of structural arrangement of the nozzles A and B, and unevenness in flying speeds of respective ink droplets, that is, unevenness in timing at which the charging voltage is applied and the ink collides with the workpiece, printing of columns with even interval cannot be realized unless the interval between the print character column of the nozzle A and the print character column of the nozzle B are controlled. Thus, in order to address the problems, a function capable of independently adjusting application timings of charging voltages to be applied to ink droplets jetted from the respective nozzles is provided. This enables the print column interval to be evenly controlled, thereby allowing the print quality to be improved. More specifically, test printing is preliminarily performed; on the basis of a printed result thereof, the operator may adjust the timings of generating charging voltages by the respective charging voltage generating circuits A_9 and B_23 in FIG. 4, using an after-mentioned GUI (see an example of an input panel 4 (FIG. 10)).

Figure 7:
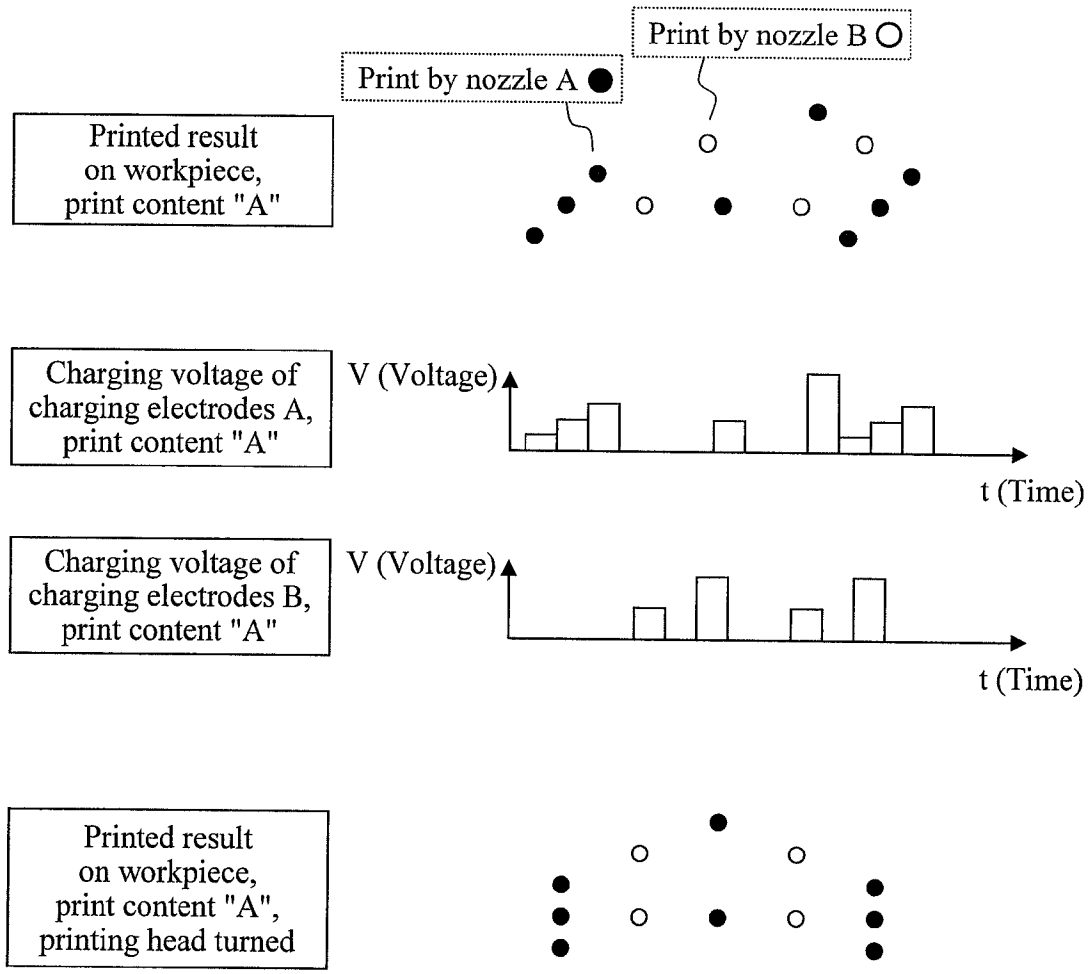
FIG. 7 is a diagram showing a print example (high speed printing) and an example of charging voltage waveforms (2) according to two-nozzle printing head configuration in the present embodiment.

FIG. 7 is a diagram showing an example of a printed result on the workpiece and examples of charging voltage waveforms for the nozzles A and B in the case of actually printing print content "A". Also in this case, as with the case shown in FIG. 2, turning of the printing head corrects the slanting of the character in the printed result on the workpiece, thereby enabling high quality printing to be performed as shown in FIG. 7.

Figure 8:
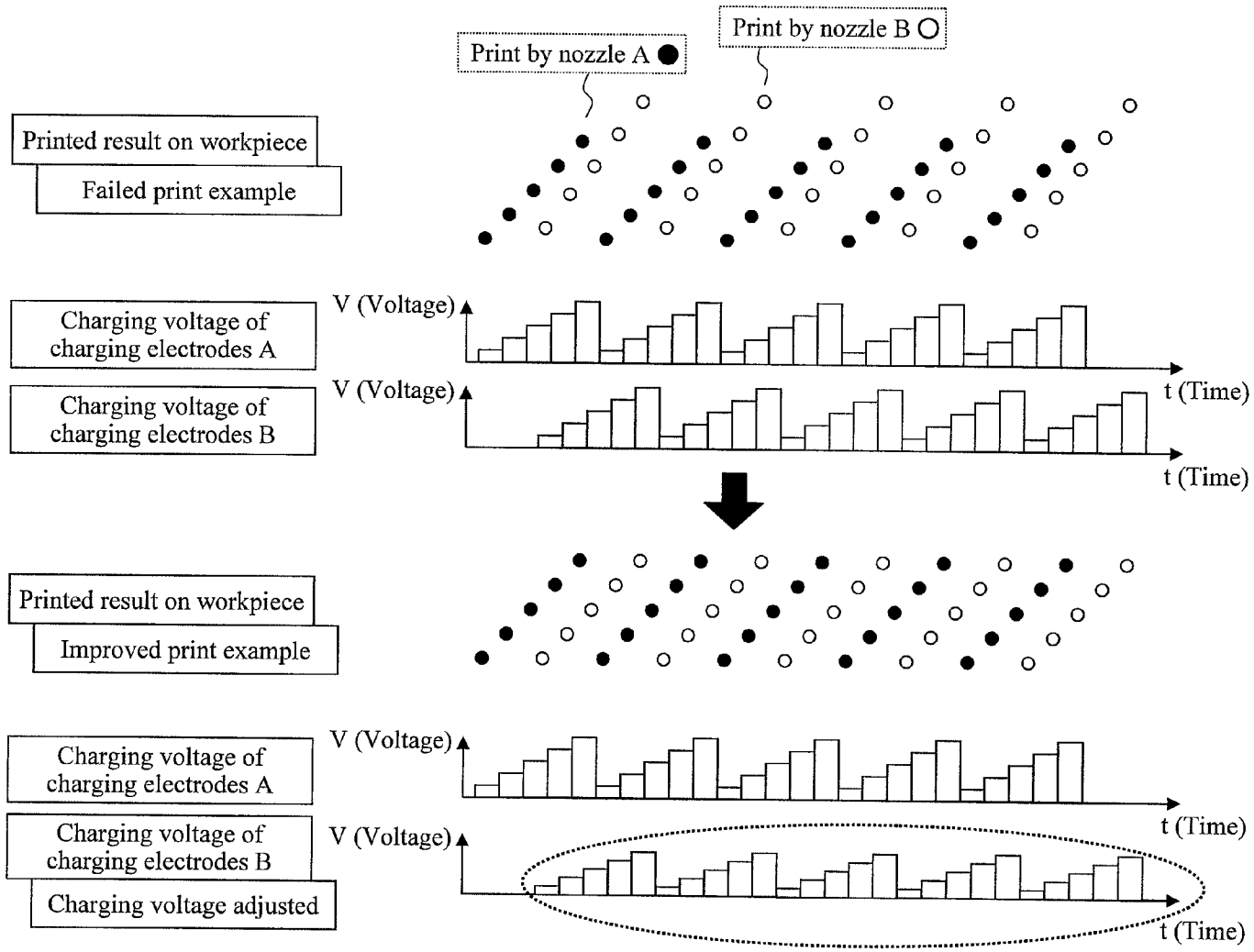
FIG. 8 is a diagram showing a failed printing example and an improved print example (high speed printing), and an example of charging voltage waveforms according to two-nozzle printing head configuration in the present embodiment.

Referring to FIG. 8, a solution for the second problem in the print example by the two nozzles (degradation in print quality owing to uneven dot pitches in the horizontal direction printed from the nozzles) will be described.

The upper part of FIG. 8 shows a failed printing example on the workpiece in the case of applying an identical charging voltage value to each nozzle. The inkjet recording device in the present embodiment adopts a principle in which, when the ink droplet is cut off in the charging electrodes, a charging voltage is applied to charging electrodes and the ink droplet is supplied with a charge, then the droplet is deflected according to the amount of this charge in the deflection electrodes, and the workpiece advances in the direction substantially perpendicular to the ink droplet flying direction and the charged ink droplet deflection direction to thereby form a print character. However, in this case, unevenness in the amount of charge of the charged ink droplet jetted from each nozzle and the ink flying speed in turn causes unevenness in the amount of deflection of the charged ink droplet. The unevenness is caused owing to unevenness in the positional relationship between the flying ink droplet and the charging electrodes, ink jetting pressure, the ink viscosity and the like, which are main factors. That is, even with a favorable repeat accuracy at a single nozzle, unevenness between the nozzles is high, and, even the same charging voltage waveform is actually applied to the charging electrodes A and B, the amounts of deflection of the charged ink droplets are different from each other. Accordingly, failed printing may occur as shown in the upper part of FIG. 8.

In order to address the problem, a configuration is adopted that has a function allowing the inkjet recording device to independently adjust the charging voltage values using the input panel 4 (GUI example (see FIG. 10)). For instance, as shown in the lower part of FIG. 8, when an input of the setting value of a character height from the input panel is changed, the charging voltage value is changed accordingly. That is, in the case of the upper part of FIG. 8, the voltage value to be applied to the charging electrode B for the nozzle B is too high (the amount of charge of the ink droplet is too large). Accordingly, the amount of deflection of the ink droplet from the nozzle B is largely different from the amount of deflection of the ink droplet from the nozzle A. However, as shown in the lower part of FIG. 8, the voltage value applied to the charging electrode B for the nozzle B is adjusted to be small, thereby allowing the amount of deflection of the ink droplet to be adjusted; this realizes control to acquire an appropriate character height. Accordingly, adjustment in comparison with the result of printing on the actual workpiece enables the print quality to be improved.

Figure 9:
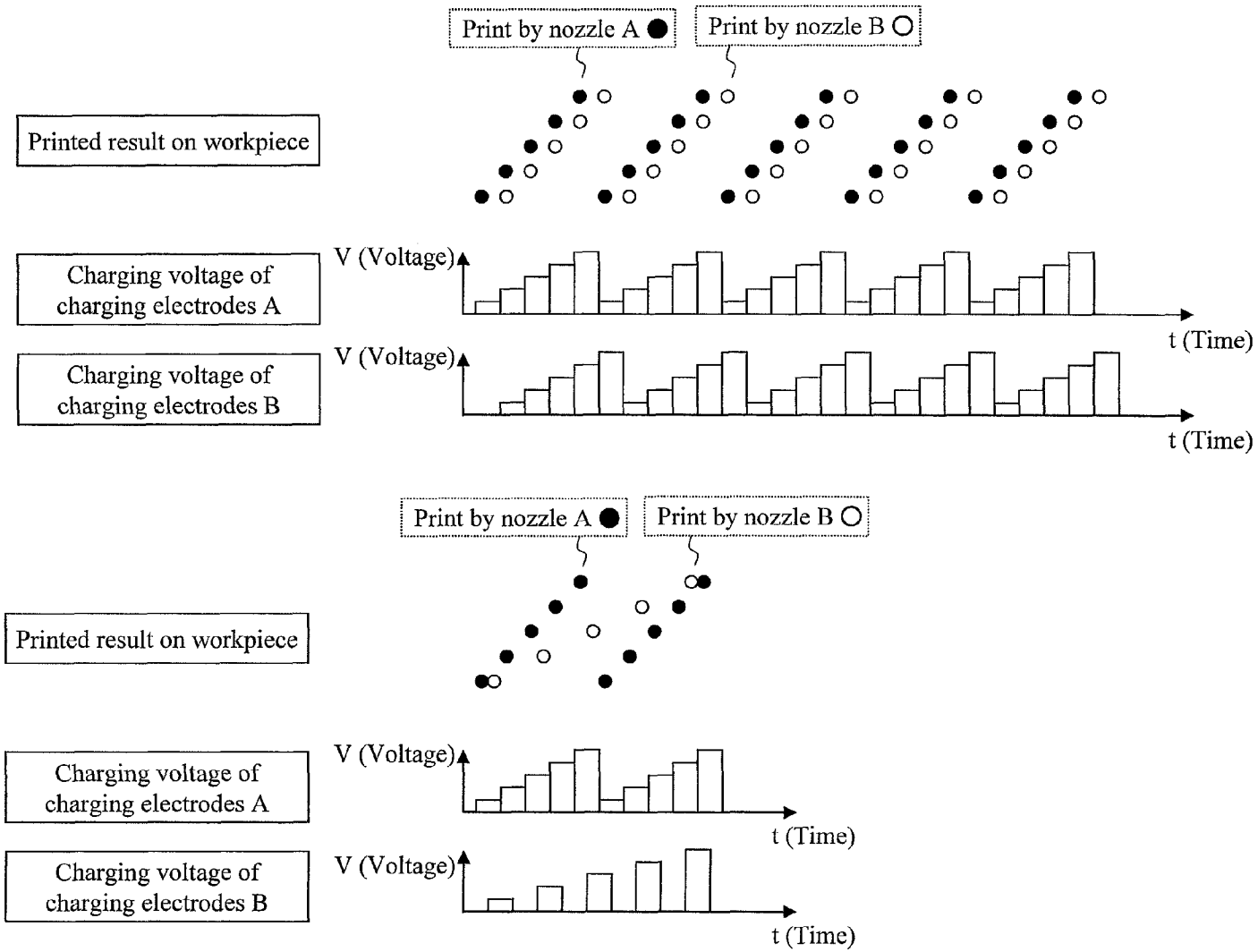
FIG. 9 shows an applied print example (special pattern) that can be realized in the case of implementing the two-nozzle printing head configuration of the present embodiment. The upper part of FIG. 9 shows a case of separately controlling print start timings for respective nozzles. The lower part of FIG. 9 shows a case of separately controlling droplet usage rates for the respective nozzles.

FIG. 9 is a diagram showing a print example (special pattern) enabled by the printing method of the present embodiment. The upper part of FIG. 9 shows a method for realizing printing of a bold character. The lower part of FIG. 9 shows a method for realizing printing of a character for a special purpose.

As shown in the upper part of FIG. 9, in the case of printing a bold character, timings of starting charging voltages to be applied to the respective pairs of charging electrodes are intentionally adjusted such that the printing width on the workpiece and the print column interval are identical to the intervals of the one-nozzle, and one column is printed by the two nozzles. This allows one column of printing to be represented in a bold manner, thereby enabling dense printing to be realized as a printed result.

As shown in the lower part of FIG. 9, in the case of printing a character for a special purpose, in addition of changing the timings of starting charging voltages to be applied to the respective pairs of charging electrodes and changing the charging voltage values, droplet usage rates are changed. For instance, the usage rate of the droplet from the nozzle A is set to 1/1, and the usage rate of the droplet from the nozzle B is set to 1/2. Accordingly, a print example in which the slant of a character column printed by each nozzle is changed can be realized. Thus, this method can be used for special printing purposes, such as for a symbol and a logotype.

<Configuration and Operation of Input Panel (GUI)>

Figure 11:
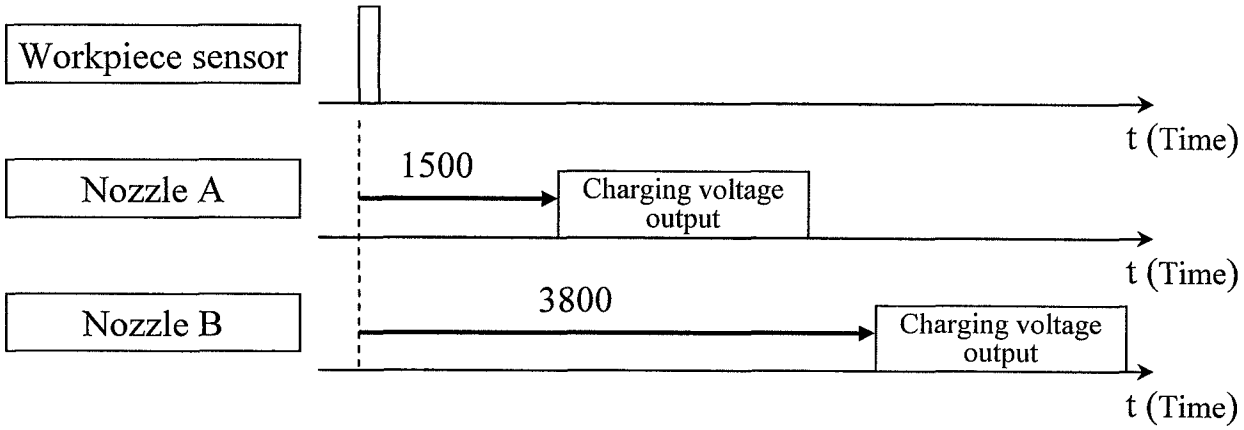
FIG. 11 is a diagram showing a print control example using the setting screen (GUI) according to the present embodiment, and illustrates a print start timing chart.
Figure 12:
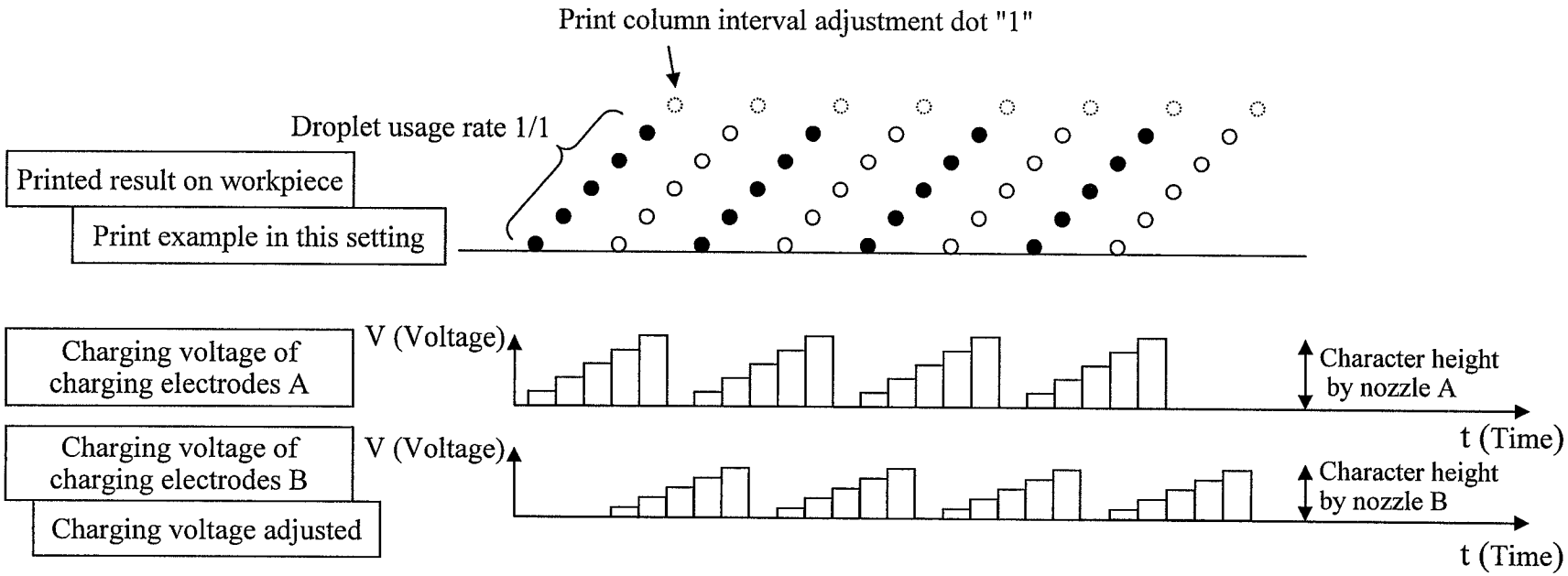
FIG. 12 is a diagram showing a print control example using the setting screen (GUI) according to the present embodiment, and illustrates an example of a printed result and charging voltages.

Subsequently, referring to FIGS. 10 to 12, processes from input of information from a setting screen (input panel 4) to output of charging voltages will be described. FIG. 10 shows a setting screen example. FIG. 11 shows a timing chart illustrating timings from detection by the workpiece sensor to output of charging voltages applied to ink droplets jetted from the nozzles A and B. FIG. 12 shows a printed result and an example of charging voltage waveforms at this setting.

The setting screen example 54 according to the present embodiment has a configuration capable of arbitrarily separately changing the timings from detection by the workpiece sensor to output of charging voltages to be applied to the respective nozzles according to setting information on a print start position that has been input by the operator. FIGS. 4 and 5 shows the circuit configuration and the external overview of the inkjet recording device; as shown in the diagrams, the plurality of nozzles are arranged in the direction where the workpiece as the print object advances. In this case, in consideration of accommodation to a case where the moving speed of the workpiece is changed and situations that the speeds of the ink droplets jetted from the respective nozzles are not completely identical to each other, it is necessary to allow the print column interval of ink droplets jetted from the respective nozzles to be finely adjusted. Thus, in order to address this problem, the setting screen 54 is prepared. Specific values can be input for adjusting the print start position, character height, droplet usage rate, and print column interval. This allows the timings of outputting charging voltages to be finely adjusted.

First, the print start position will be described. The clock for a print dot as a unit of fine adjustment and a print character column (scan) are generated by the frequency division counter 16. Accordingly, in order to realize fine adjustment, a configuration is adopted that delays charging voltage output timing on the basis of the timing signal. As shown in FIG. 11, the timing of outputting the charging voltage is determined on the basis of print start positions for the respective nozzles that have been input from the setting screen 54. For instance, as described with reference to the upper part of FIG. 9, the bold character can be printed by slightly shifting the print start positions for the respective nozzles to overlap with each other. In the case of normal printing (a case of printing one line of a character string by two nozzles), the timings are set such that the print character column from the nozzle B is disposed within an intermediate region between print character columns from the nozzle A (see FIG. 6).

Next, the character height setting will be described. In order to address the problem in that the speeds of ink droplets jetted from the respective nozzles are not completely identical to each other and unevenness in character height occurs, the present embodiment allows the charging voltage to be adjusted because the nozzles share the deflection electrodes. As shown in the upper part of FIG. 10, the nozzles have respective character height setting functions. Setting information is independently input with respect to each nozzle, and a charging voltage width can be adjusted. Here, the charging voltage width means a difference between the charging voltage for printing at the lowest position and the charging voltage for printing at the highest position. The printed character height is changed according to the charging voltage width.

As to the droplet usage rate, as shown in the upper part of FIG. 10, it is configured to allow settings of the droplet usage rate to be adjusted separately for the respective nozzles. This enables the slants of the print character column (dot string) from the respective nozzles to be separately adjusted (see the lower part of FIG. 9). Further, as to the print column interval adjustment value, as shown in FIG. 12, a charging voltage waveform is adopted that inserts a non-print dot, at which printing is not performed on the print column interval, at a unit of an ink droplet generating dot with respect to each nozzle according to the print column interval adjustment value. This enables the print column interval to be adjusted without changing the slant of the print character column (dot string) to be printed from each nozzle.

<Print Dot Data Control>

Figure 13:
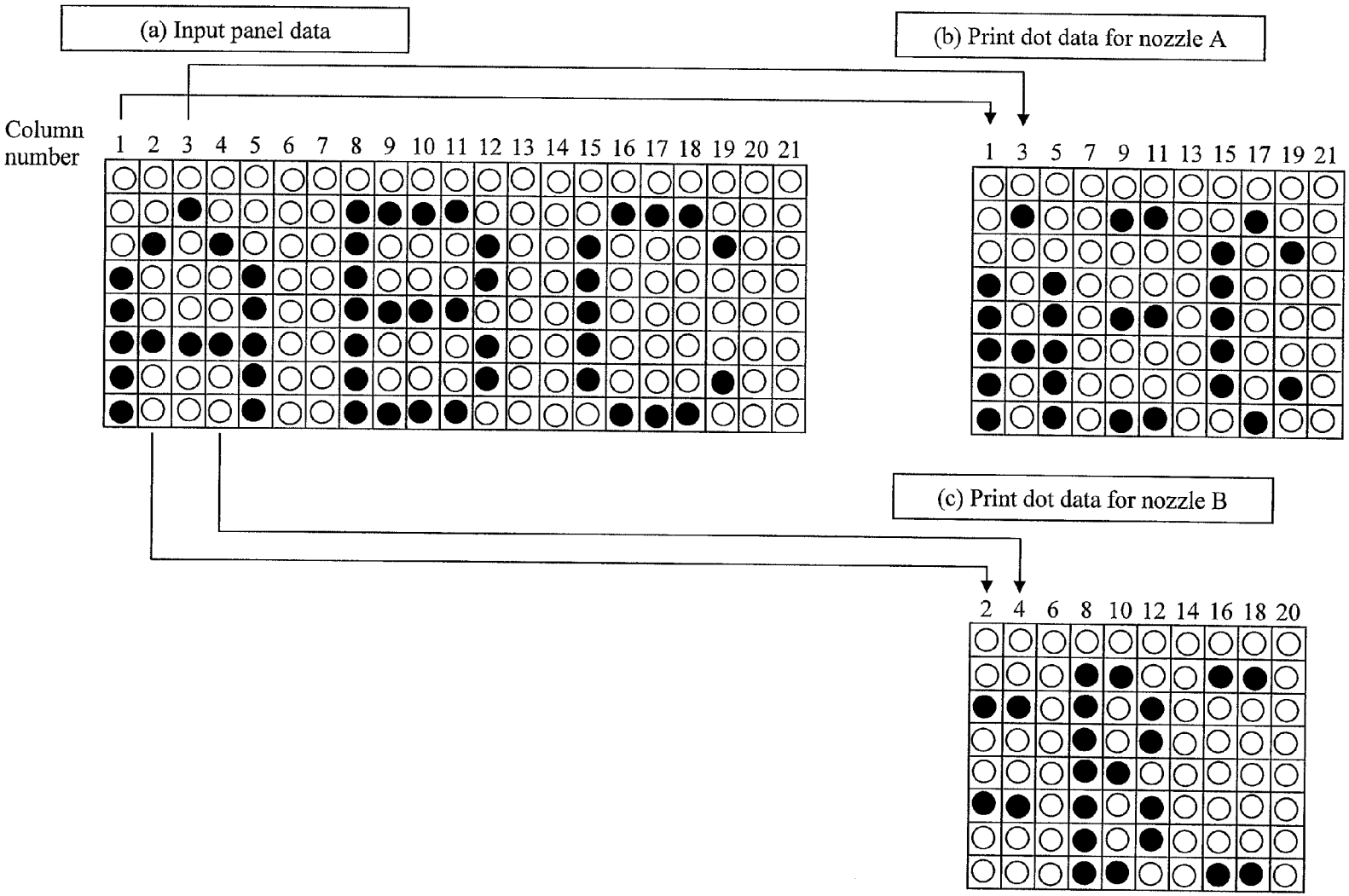
FIG. 13 is a diagram showing an example of control of dividing print dot data according to the present embodiment.

FIG. 13 is a diagram illustrating a concept of print dot data control. Specific print dot control is performed by the MPU 1, which develops dot data in the RAM 3 on the basis of information set from the input panel 4 shown in FIG. 4 as a hardware configurational element to issue instructions on charging voltage values and timings to be applied to the charging voltage generating circuit A_9 and the charging voltage generating circuit B_23.

FIG. 13 shows a print dot data example on the input panel and pieces of data to be assigned from the input print dot data to the nozzles A and B. More specifically, as to the dot data, in the case where the two nozzles print characters as with print dot data (b) for the nozzle A and print dot data (c) for the nozzle B, the MPU 1 develops dot data for odd-numbered column for the nozzle A, and develops dot data for even-numbered column for the nozzle B, in an alternate manner with respect to the column, using a temporary storing region in the RAM 3. Here, the odd-numbered column and the even-numbered column may be inverted. However, the development is made in an alternate manner for each column. For instance, in the case where the number of nozzles is three, the control according to the present invention can be realized by developing the first, fourth and seventh columns for a nozzle A, developing the second, fifth and eighth columns for a nozzle B, and developing the third, sixth and ninth columns for a nozzle C.

<Conclusion>

In the printing head of the inkjet recording device in the present embodiment, the plurality of nozzles and pairs of charging electrodes corresponding to the respective nozzles, and the deflection electrodes are arranged. Here, the direction in which the plurality of nozzles are arranged is orthogonal to the direction in which the charged ink droplet is deflected. The controller (MPU) of the inkjet recording device develops the print character input from an input section in a manner of a dot matrix, assigns the pieces of dot data to the respective nozzles, controls the operation of jetting ink from the nozzles, the values of charging voltage applied to the charging electrodes, and the application timing, and causes the nozzles to print one line of a character string on the print object. The character of dot string from the nozzles are sequentially printed (in the case of two nozzles, the character is alternately printed), thereby printing the one line of the character string on the print object. This enables the character to be printed at favorable print quality without widening the character width of the printed result even if the transfer speed of the print object is high.

Irrespective of the number of installed nozzles and the number of installed pairs of charging electrodes, the deflection electrodes consist of the single pair of plate electrodes. One system of the pair of deflection electrodes and the direct-current voltage for forming the deflection electric field can realize the implementation, thereby allowing an inexpensive device to be provided. That is, only one power source for applying the voltage to the deflection electrodes is suffice, which allows the cost of the device to be reduced. In the case of a plural pairs of deflection electrodes may cause a discharge in a slit (gap) between the electrodes pairs. However, the present embodiment can prevent such situations from occurring, and can stably deflect the ink droplets.

In the present embodiment, print condition setting sections capable of independently setting print conditions are provided for the respective nozzles. In this case, the controller controls the ink jetting operation, the charging voltage value, and the application timing, according to the print condition set by the print condition input section. Thus, characters can be printed, while changing the print condition at a unit of the nozzle. This enables the print operation to be finely adjusted at the unit of the nozzle.

More specifically, when an instruction of adjusting the print character height is made from the print condition setting section, the controller adjusts the value of the charging voltage to be applied to the charging electrodes corresponding to the nozzle on which the print character height is to be adjusted. Accordingly, even in the case where the same voltage value is set for the each nozzle, even if unevenness in printing height occurs between the nozzles, the fine adjustment allows the height of one line of a character string realized by the nozzles to be uniform.

When an instruction of adjusting the print start timing is made from the print condition setting section, the controller adjusts the application timing of the charging voltage to be applied to the charging electrodes corresponding to the nozzle on which the print start timing is to be adjusted. Thus, the adjustment on the print start timings between the nozzles allows fine deviations of print timings between the nozzles to be corrected. Further, in the case of adjusting the print start timings such that the print dots of the nozzles overlap with each other, a special character printing (printing of a decorated character), such as a bold character, can be supported.

When an instruction of adjusting the print column interval is made from the print condition setting section, the controller adjusts the print column interval by applying, to the charging electrodes, a charging voltage for inserting a non-print dot, at which printing is not performed on the print column interval, at a unit of an ink droplet generating dot according to amount of adjustment of the print column interval for each nozzle. This allows printing of one line of a character string to be realized by the plurality of nozzles while adjusting the print column interval according to the representation of the input character string.

In the case where the usage rates of ink droplets jetted from the respective nozzles are set to be different from each other from the print condition setting section, the controller realizes a special print pattern by controlling the slant of the dot string generated by the nozzles on the basis of the usage rates. This allows printing of the character string having a special shape to be supported.

As described above, adjustment of combination of the character height, print start timing, print column interval and droplet usage rate allows printing of various one-line character strings to be realized.

The present invention prevents the character width of the printed result from being increased even if the transfer speed of the print object is increased, thereby enabling the print quality to be improved.

The invention may be embodied in other specific forms without departing from the sprit or essential characteristics thereof. The present embodiment is therefore to be considered in all aspects as illustrative and not restrictive, the scope of the invention being indicated by the appended claims rather than by the foregoing description and all changes which come within the meaning and range of equivalency of the claims are therefore intended to be embraced therein.

Reference Signs List

1 . . . MPU, 2 . . . ROM, 3 . . . RAM, 4 . . . input panel, 5 . . . circulation control circuit, 6 . . . circulation system components, 7 . . . bus line, 8 . . . print start signal instruction circuit A, 9 . . . charging voltage generating circuit A, 10 . . . droplet usage rate switch A, 11 . . . excitation setting switch A, 12 . . . oscillator A, 13 . . . phase detection circuit A, 14 . . . charging D/A converter, 15 . . . AMP, 16 . . . frequency division counter A, 17 . . . excitation voltage generating circuit A, 18 . . . AMP, 19 . . . AMP, 20 . . . deflection D/A converter, 21 . . . AMP, 22 . . . print start signal instruction circuit B, 23 . . . charging voltage generating circuit B, 24 . . . droplet usage rate switch B, 25 . . . excitation setting switch B, 26 . . . oscillator B, 27 . . . phase detection circuit B, 28 . . . charging D/A converter B, 29 . . . AMP, 30 . . . frequency division counter B, 31 . . . excitation voltage generating circuit B, 32 . . . AMP, 33 . . . AMP, 34 . . . print object detection circuit, 35 . . . nozzle A, 36 . . . electrostrictive element A, 37 . . . charging electrode A, 38 . . . phase retrieval sensor A, 39 . . . gutter A, 40 . . . nozzle B, 41 . . . electrostrictive element B, 42 . . . charging electrode B, 43 . . . phase retrieval sensor B, 44 . . . gutter B, 45 . . . negative deflection electrode, 46 . . . positive deflection electrode, 47 . . . printing head, 48 . . . workpiece sensor, 49 . . . workpiece, 50 . . . conveyor, 51 . . . charging system circuit A, 52 . . . charging system circuit B, 53 . . . printing head cover, and 54 . . . setting screen (GUI) example.

The invention claimed is:

1. An inkjet recording device performing printing on a print object being transferred, comprising:

a plurality of nozzles;

a plurality of pairs of charging electrodes disposed so as to correspond to the respective nozzles, for charging ink droplets jetted from these nozzles;

a pair of deflection electrodes deflecting the charged ink droplets;

an input section from which a print character is input; and a controller that develops the print character input from the input section in a manner of a dot matrix, assigns pieces of dot data to the respective nozzles and controls an operation of jetting ink from the nozzles, a value of the charging voltage to be applied to the pair of charging electrodes, and an application timing, wherein a direction in which the nozzles are arranged is orthogonal to deflection direction of the charged ink droplets, and the plurality of nozzles print one line of a character string on the print object, wherein the input section includes a print condition setting section capable of independently setting print conditions for the respective nozzles, and the controller controls the operation of jetting ink, the value of the charging voltage, and the application timing, according to the print conditions set from the print condition input section.

2. The inkjet recording device according to Claim 1, wherein the deflection electrodes include a pair of plate electrodes irrespective of the installed number of the nozzles and the installed number of the pairs of the charging electrodes.

3. The inkjet recording device according to claim 1, wherein when an instruction of adjusting a print character height is issued from the print condition setting section, the controller adjusts the value of the charging voltage to be applied to the charging electrodes corresponding to the nozzle for which the print character height is to be adjusted.

4. The inkjet recording device according to claim 1, wherein when an instruction of adjusting a print start timing is issued from the print condition setting section, the controller adjusts an application timing of the charging voltage to be applied to the charging electrodes corresponding to the nozzle for which the print start timing is to be adjusted.

5. The inkjet recording device according to claim 1, wherein when an instruction of adjusting a print column interval is issued from the print condition setting section, the controller adjusts the print column interval by applying, to the charging electrode, a charging voltage for inserting a non-print dot at which printing is not performed on the print column interval, at a unit of an ink droplet generating dot according to an amount of adjustment of the print column interval for each nozzle.

6. The inkjet recording device according to claim 1, wherein when droplet usage rates of the ink droplets to be jetted from the respective nozzles are set to be different from each other from the print condition setting section, the controller realizes a special print pattern by controlling a slant of a dot string to be generated at each nozzle on the basis of the usage rate.

7. The inkjet recording device according to claim 1, wherein the controller prints the one line of the character string on the print object by sequentially performing printing of a dot string from the nozzles.

* * * * *